United States Patent [19]

Pittman et al.

[11] 4,290,788

[45] Sep. 22, 1981

[54] ELECTROSTATIC AIR CLEANER AND MOUNTING MEANS THEREFOR

[75] Inventors: Robert R. Pittman; Clifford B. Elbrader; Jimmy L. Milum, all of Harrison, Ark.

[73] Assignee: Emerson Electric Co., St. Louis, Mo.

[21] Appl. No.: 100,474

[22] Filed: Dec. 5, 1979

[51] Int. Cl.[3] ..... B03C 3/12; B03C 3/34

[52] U.S. Cl. ..... 55/138; 55/143; 55/146; 55/481

[58] Field of Search ..... 55/138, 143, 145–146, 55/140, 101, 481

[56] References Cited

U.S. PATENT DOCUMENTS

| | | | |
|---|---|---|---|
| 2,780,305 | 2/1957 | Bonatz | 55/146 X |
| 3,665,679 | 5/1972 | McLain et al. | 55/145 X |
| 3,733,783 | 5/1973 | Burney | 55/143 X |
| 3,763,633 | 10/1973 | Soltis | 55/126 |

OTHER PUBLICATIONS

W. W. Granger Catalog, Catalog No. 353, Spring '79, W. W. Granger Inc., Chicago, Ill., pp. 696–697.

*Primary Examiner*—Kathleen J. Prunner
*Attorney, Agent, or Firm*—Charles E. Markham

[57] ABSTRACT

A rigid cutout template is attached to the thin wall of a return air duct and suitably positions and supports an electrostatic air cleaner inserted into the duct through a cutout therein defined by the template. A power-pac and control box is secured elsewhere to the duct and includes high voltage power supply means, an air flow responsive switch and means visually indicating the existence of a power supply, the connection therewith of the electrostatic cell, and normal and abnormal current flow through the electrostatic cell.

4 Claims, 15 Drawing Figures

FURNACE
POWER PAC
CELL
BLOWER
RETURN AIR DUCT

FURNACE
BLOWER
RETURN AIR DUCT
POWER PAC
CELL 80
10
COVER
128
102
CELL
PRE FILTER
108
66
FURNACE
RETURN AIR DUCT
CUT OUT
TEMPLATE AND SUPPORT FRAME
POWER PACK AND CONTROL 68
72
86
79
78
66
62
60
104
82
80
22
20
40
12
30
32
34
36
89
90
95
98
100
102
94
54
56
51
96
50
44
46

80
84
86
92
106
104
88
11

82
80
90
86
104
84
88

72
78
74
76
66
68

9
66
68
74
70
69
76
78
72

ELECTRO CELL
SIGNAL LIGHTS
D.C. POWER SUPPLY
AIR FLOW SWITCH

RED
GREEN

ELECTROSTATIC AIR CLEANER AND MOUNTING MEANS THEREFOR

This invention relates generally to electrostatic air cleaners for residential use and particularly to simple and economical means for mounting an electrostatic air cleaner of adequate capacity in an existing return air duct or furnace and for visually indicating its operational condition.

BACKGROUND OF THE INVENTION

The effectiveness of electrostatic air cleaners installed in residential heating and cooling systems is well recognized and appreciated particularly by those bothered by allergenic air pollutants. However, the relatively high cost and objectionable $0^3$ generation of units having adequate capacity has in the past deterred wider use of these air cleaners in residences. While substantial design improvement, minimization of $0^3$ accumulation and reduction of construction cost of the electrostatic air cleaner have been made, the cost of installation particularly in existing residential heating and cooling systems has not decreased.

Less expensive, relatively easy to install electrostatic air cleaners of less than adequate capacity for the average size residence are presently commercially available. These air cleaners are dimensioned to replace the conventional one inch thick fiber glass filter usually positioned in a furnace or return air duct and are of single stage construction an example being the air cleaner disclosed in U.S. Pat. No. 3,763,633 to C. W. Soltis and shown on page 696 of a W. W. Granger Inc. catalog. In the Granger air cleaner the power supply may be interconnected with the furnace blower motor so that it is energized only when air is being circulated thereby to preclude accumulation of $0^3$ during the blower off cycle. Such interconnection however is required to be made by a licensed electrician and therefore substantially increases installation cost.

A larger capacity two-stage electrostatic air cleaner is shown on page 697 of the same Granger catalog sheet. This larger electrostatic cell with its attached high voltage power supply is relatively heavy and requires substantial and costly modification of an existing air return duct for its positioning and support therein as is shown in FIGS. 1 and 2 of U.S. Pat. No. 3,989,486.

OBJECTS OF THE INVENTION

The primary object of this invention is to provide a generally new and improved two-stage electrostatic air cleaner of adequate capacity for the average residence with mounting means which faclitates the installation thereof in a return air duct or furnace by a person having ordinary skill employing simple tools.

A further object is to provide an electrostatic air cleaner as in the preceding paragraph including switching means responsive to air flow through the return air duct.

A further object is to provide means for grounding any residual charge remaining in the cell collector plates prior to access to the cell for its removal.

A further object is to provide an electrostatic air cleaner having visual means indicating the existence of a power supply, the connection thereto of the electrostatic cell and normal and abnormal current flow through the electrostatic cell.

Other objects and advantages will appear when reading and following description in connection with the accompanying drawings.

IN THE DRAWINGS

FIG. 1 is an exploded perspective view of the components of an electrostatic air cleaner and mounting means therefor constructed in accordance with the present invention.

FIG. 2 graphically illustrates the installation of the air cleaner cell in a return air duct leading to the bottom of a single compartment furnace with the power-pac and control box mounted on the surface of the duct in spaced relationship with the cell.

FIG. 3 graphically illustrates the installation of the air cleaner cell in a return air duct leading to the top of a two compartment furnace with the power-pac and control box mounted on the surface of the duct. This figure also graphically illustrates an alternate installation of the air cleaner cell in the return air compartment of a two compartment furnace. In this arrangement the air cleaner cell may be additionally supported on the usual frame provided to receive the usual one inch thick fiber glass filter.

DESCRIPTION OF A PREFERRED FORM OF THE INVENTION

Figures 1, 2, 3:
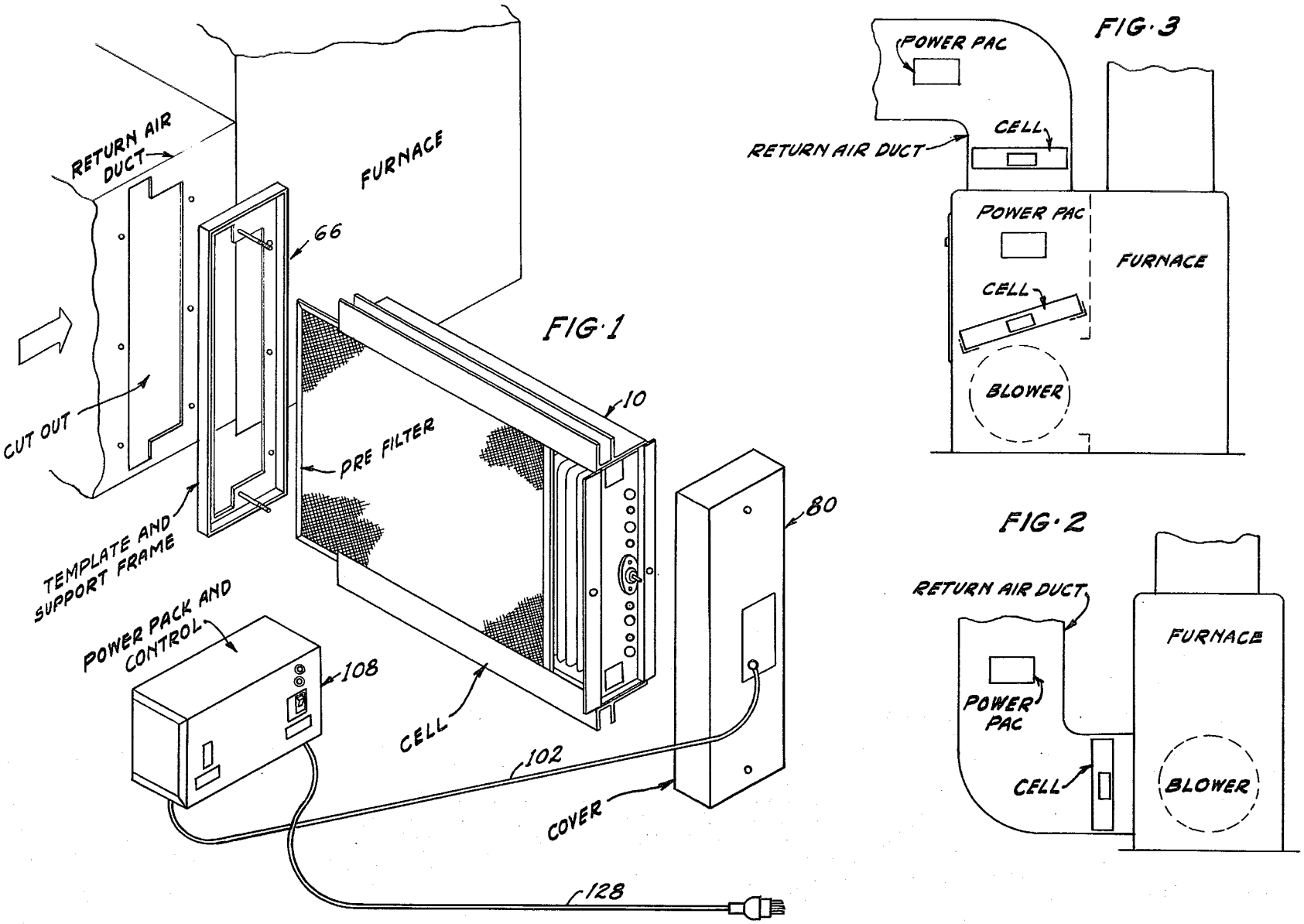

Referring to FIGS. 4 to 7 of the drawings an electrostatic cell generally indicated at 10 comprises an open rectangular frame having a front vertical end member 12, a rear vertical end member 14 and upper and lower horizontal side member 16 connected thereto by rivets 17. Vertical end members 12 and 14 are of general channel form in cross section having outwardly extending flanges 18 and web portions 20 which web portions 20 form the cell end plates.

The flanges of front channel member 12 are formed at 90 degrees to provide flat flange portions 22 extending outwardly from and along opposite sides of said member parallel with the webs 20. There is a hole 23 in each of the flange portions 22 for receiving cell locator pins to be described.

Upper and lower horizontal frame members 16 are generally of channel form in cross section with inwardly extending flanges overlying and being riveted to end portions of flanges 18 of the vertical members 12 and 14 by the rivets 17. Horizontal frame members 16 also each include a pair of spaced outwardly extending portions 24 forming rails for a purpose to be described and for adding rigidity to members 16. Members 16 further include inwardly extending portions 25 lying alongside and spaced from the inwardly formed flanges thereof at one side of the frame to provide grooves in which to insert a prefilter. Upper and lower horizontal members 16 may be formed as extrusions of suitable light weight metal.

Cell 10 further includes a plurality of parallel equally spaced and alternately arranged positively charged (positive) collector plates 26 and grounded (negative) collector plates 28. The positive plates 26 are supported by and suitably attached to tubes 30 through which extend support rods 32. Negative collector plates 28 are supported by and suitably attached to tubes 34 through which extend support rods 36. Large apertures in the collector plates space them from the tubes to which they are not attached.

Tubes 30 which support plates 26 and the support rod 32 extending through them are entered at their ends into recesses in round flanged insulators 40 which have round portions extending through round apertures in the webs 20 of vertical frame members 12 and 14. The support rods 36 which extend through tubes 34 supporting the negative plates 28 have screw threaded end portions extending through apertures in the webs 20 and are provided with nuts 42. The apertures in webs 20 through which the screw threaded ends of rods 36 extend are smaller in diameter than tubes 34 so that tubes 34 abut the inside surfaces of webs 20.

Figure 6:
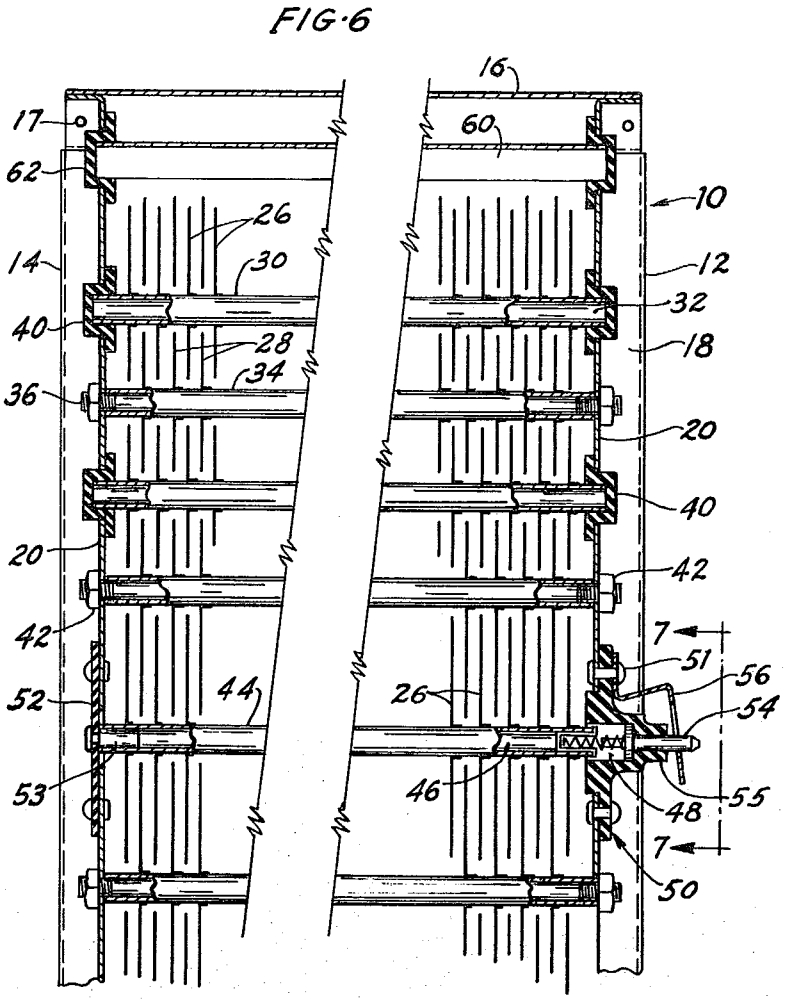
FIG. 6 is a fragmentary cross-sectional view of the electrostatic cell taken along line 6—6 of FIG. 5.
Figure 12:
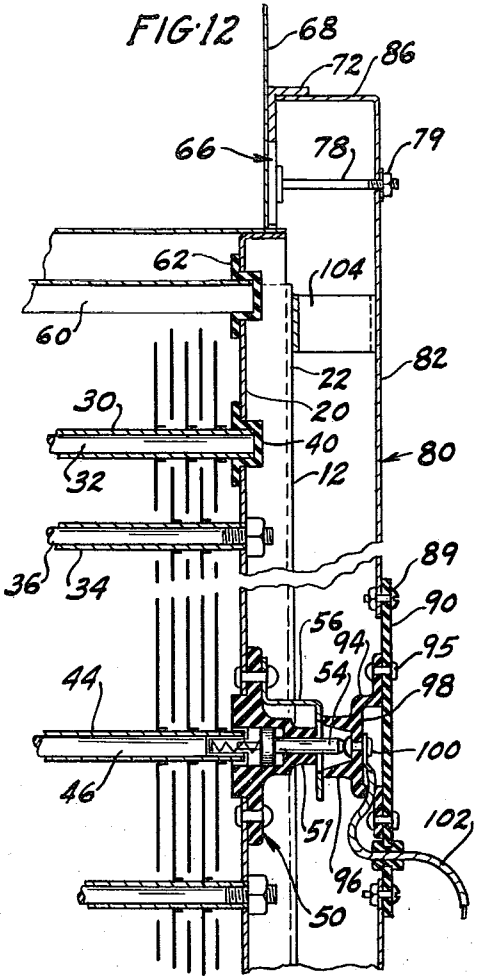
FIG. 12 is an enlarged fragmentary cross-sectional view showing the template mounted on the wall of a duct, the electrostatic cell inserted into the duct through a cutout therein and the cover member attached to the template and holding the cell in position on the template.

An intermediate one of the tubes supporting the positive collector plates 26, designated at 44 in FIG. 6, is provided with a somewhat shorter internal support rod 46 which has its ends spaced from the ends of tube 44. Referring to FIG. 6 or 12, the right end of the tube 44 is entered into a counterbore 48 in the interiorly facing surface of an insulator 50 mounted in an aperture in and attached to the web 20 of vertical frame member 12 by rivets 51. The left end of tube 44 is fitted over a stud 53 attached to an insulator 52 connected to the web of vertical frame member 14.

The insulator generally indicated at 50 also has a portion 55 extending exteriorly of the frame member 12 and a bore through this portion 55 slidably receives a round, flanged contactor pin 54 which extends interiorly into the counterbore 48 and exteriorly from the insulator portion 55. A spring in the counterbore 48 biased between the interior end of support rod 46 and the flange of contactor pin 54 biases the contactor pin outwardly. A conductive leaf spring 56 having one end thereof connected mechanically and electrically to the frame member 12 by a rivet 51 has its other free end normally biased into contact with the exteriorly projecting portion of contactor pin 54 and normally grounds contactor pin 54 to the frame 10.

Figure 5:
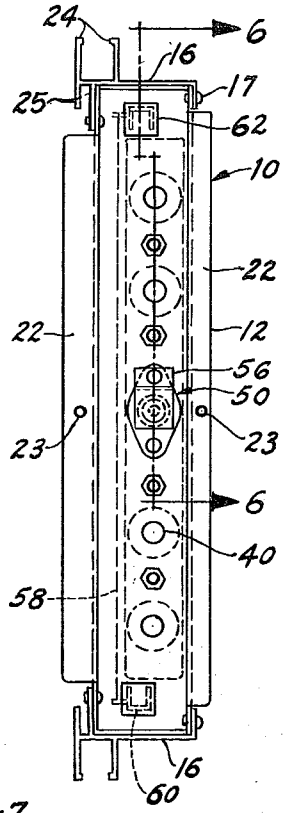
FIG. 5 is a front end view of the electrostatic cell.
Figure 7:
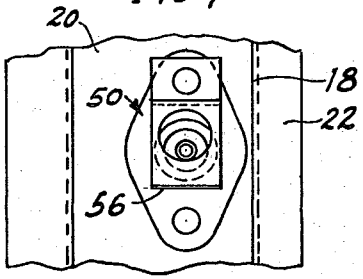
FIG. 7 is a fragmentary elevational view of the contact and grounding elements taken along line 7—7 of FIG. 6.
Figure 4:
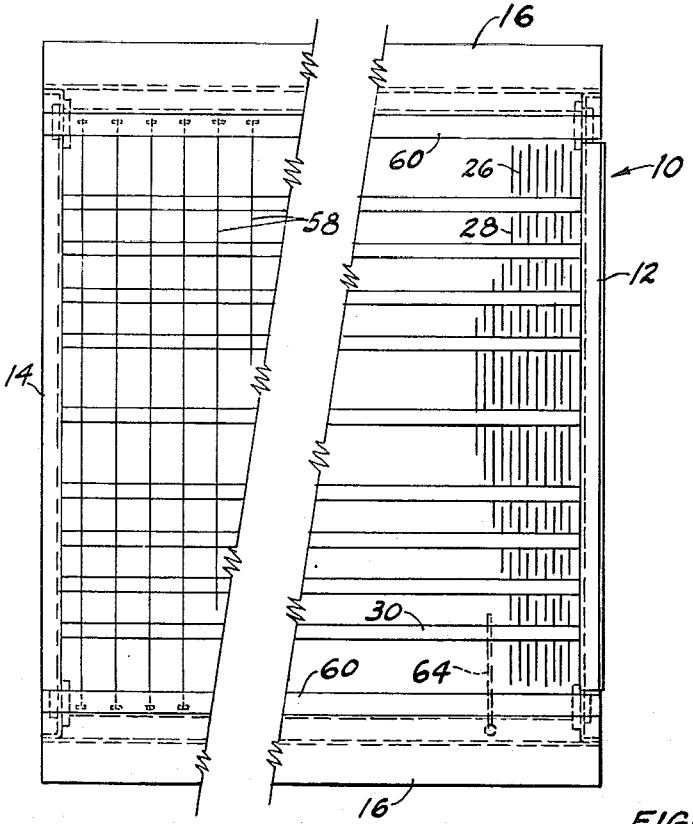
FIG. 4 is a side elevational view of the electrostatic cell.

Positively charged ionizing wires 58 arranged parallel with the collector plates 26 and 28 and spaced therefrom on the upstream side are connected at their ends to upper and lower conductive channel members 60, see FIGS. 4 and 5. The channel members 60 are supported in the frame by entering the ends thereof into recesses in flanged square insulators 62 having square portions extending through square apertures in the webs 20 of vertical frame members 12 and 14. A conductive connection 64, see FIG. 4, is provided between the lower conductive channel member 60 and one of the positively charged tubes 30. The arrangement of collector plates and ionizing wires is preferably that shown in U.S. Pat. No. 4,089,661 to Milum by which the electrostatic field is augmented.

Figure 9:
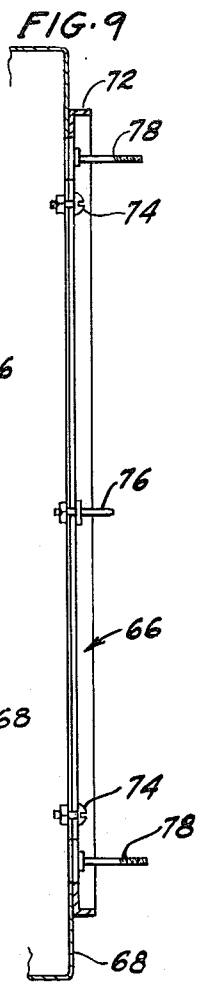
FIG. 9 is a cross-sectional view of the template and support frame taken along line 9—9 of FIG. 8.
Figure 8:
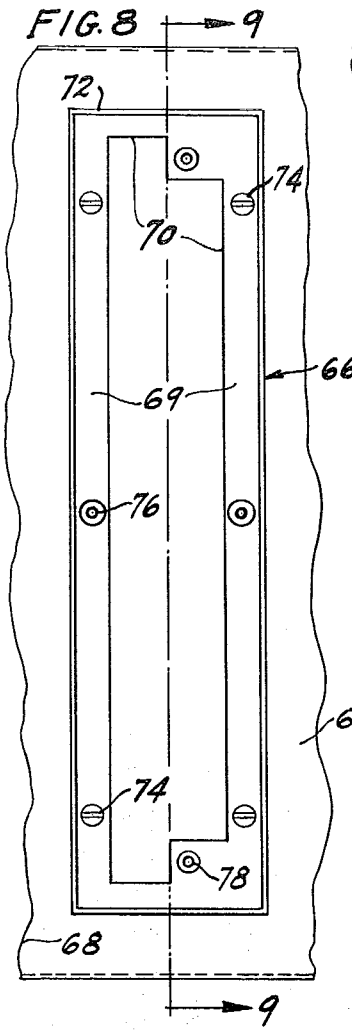
FIG. 8 is an elevational view of the cutout template and support frame shown attached to a return air duct.

Referring to FIGS. 8 and 9, a rectangular cut-out template and support frame generally indicated at 66 is shown attached to the wall of a return air duct fragmentarily shown at 68. Frame 66 has a flat marginal portion 69 adapted to lie flat against the duct wall and define a cut-out 70 to be made in the duct wall for the insertion of the electrostatic cell 10. The template and support frame 66 is formed from sheet stock which is substantially thicker than that of which ducts are usually constructed and is further provided with a peripheral flange 72 surrounding marginal portion 69 to further add rigidity thereto. The frame 66 is secured to the duct wall by bolts 74 and flanged cell locator pins 76 passing through the flat marginal portion 69 and the duct wall. Locator pins 76 have a screw threaded portion extending from one side of its flange adapted to receive a nut for attachment of frame 66 to the duct wall and a portion extending from the other side of its flange adapted to be received in holes 23 in the flange portions 22 of the cell front frame member 12 thereby to position the cell on the frame. The template and support frame 66 is further provided with upper and lower screw threaded studs 78 suitably secured to the flat marginal portion thereof for the attachment thereto of a cover member now to be described.

Figure 10:
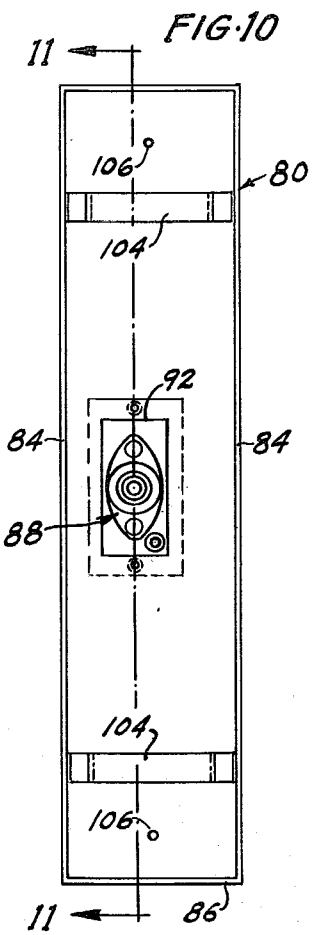
FIG. 10 is an inside elevational view of the cover member.
Figure 11:
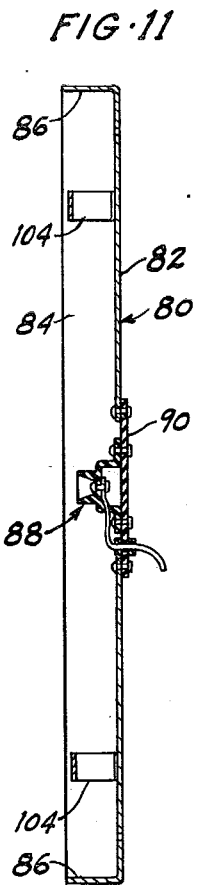
FIG. 11 is a cross-sectional view of the cover member taken along line 11—11 of FIG. 10.

A rectangular cover member generally indicated at 80 is shown in FIGS. 10 and 11. Cover member 80 has a front wall 82 and side and end walls 84 and 86 respectively adapted to fit within the peripheral flange 72 of frame 66 as shown in FIG. 12. When assembled in frame 66 the cover member is detachably connected thereto by the studs 78 and nuts 79. An insulator generally indicated at 88 mounted on a dielectric panel 90 secured to the outside of front cover wall 82 by bolts 89 projects interiorly through an aperture 92 in the wall.

Insulator 88 has a flanged and recessed base portion 94 connected to the dielectric panel 90 by rivets 95 and a round recessed portion 96 projecting inwardly therefrom with a septum 98 between the recesses in the base and projecting portion 96. A contact element 100 extending through and fixed in the septum 98 is arranged to be contacted on one side of the septum by the spring pressed contactor pin 54 when the cover 80 is assembled in frame 66. At the other side of the septum 98 the contact element 100 is connected to a high voltage cable or lead 102 extending exteriorly of the cover member 80 through a suitable grommet.

Cover member 80 is further provided with upper and lower horizontally extending spacing members 104 suitably attached to the inside of the front wall 82. Spacing members 104 are adapted to bear against flange portions 22 of front vertical channel member 12 of the cell 10 at vertically spaced points to hold the cell in alignment when the cover member 80 is assembled in and attached to the template and support frame 66. Vertically spaced holes 106 in the front wall 82 of the cover 80 receive the screw threaded studs 78 attached to frame 66 and the nuts 79 thereon detachably connect the cover to frame 66. It will be seen that when cover member 80 is inserted in and attached to frame 66 that the rigidity of frame 66 is considerably increased.

Figures 13, 14, 15:
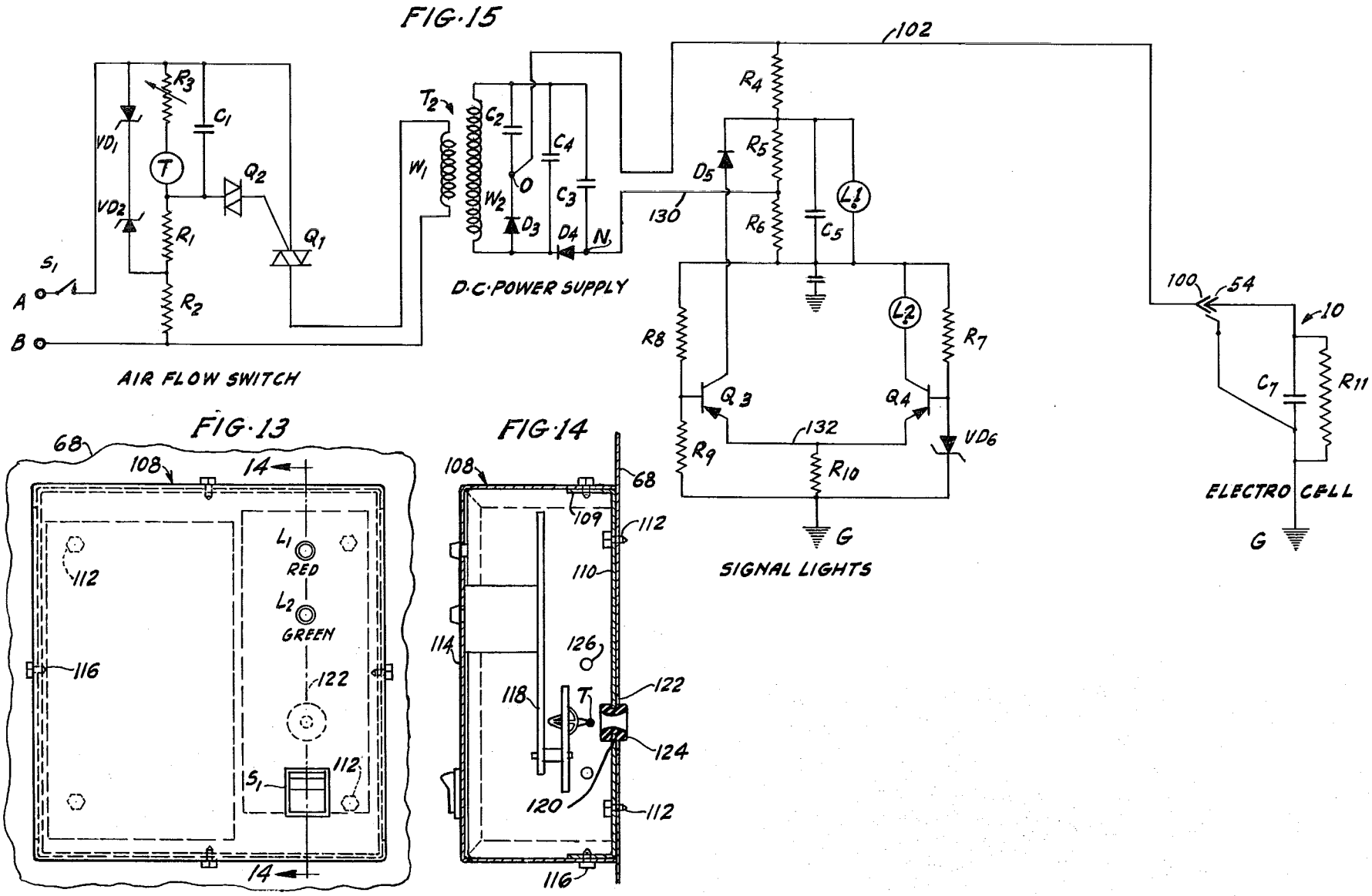
FIG. 13 is a front elevational view of the power-pac and control box.
FIG. 14 is a cross-sectional view of the power-pac and control box taken along line 14—14 of FIG. 13 and shown attached to the wall of a duct.
FIG. 15 is a diagrammatic illustration of the components and circuitry of the air flow responsive switch, the D. C. high voltage power supply, the signal lights and the electrostatic cell.

The power-pac and control box shown in FIGS. 13 and 14 and generally indicated at 108 houses the components and circuitry of the high voltage D. C. power supply to cell 10, the air flow responsive switching means, and the operational condition indicating means diagrammatically shown in FIG. 15. The box 108 has a rear base portion having a wall 110 adapted to lie flat against and be attached to a wall of a return air duct 68 by screws 112. Box 108 also includes a front cover portion 114 having sidewalls attached to turned up portions 109 of base portion 110 by screws 116. Mounted in the upper part of the front wall of the cover portion 114 is a red lamp $L_1$ and a green lamp $L_2$ and in the lower portion thereof a line switch $S_1$.

Suitably mounted on a board 118 within box 108 and closely adjacent aligned apertures 120 and 122 in the wall 110 of the box and in the wall of duct 68 respectively is a thermistor T exposed to ambient air flow through apertures 120–122 induced by air flow through return air duct 68. Preferably the aperture in wall 110 is fitted with a grommet 124 and small holes or louvres 126 may be provided in box 108 to permit free aspiration of ambient air through the grommet 124 when a blower is moving air through the return air duct. The high voltage lead or cable 102 shown connected at one end to the contact element 100 mounted in cover 80 has its other end suitably connected to the output of the D. C. power supply housed in box 108. Also the lead 128 shown in FIG. 1 leading from box 108 and including a plug-in connector for plugging into an A. C. commercial power source is suitably connected to power supply terminals A and B housed within box 108.

Referring now to the diagrammatic FIG. 15. The primary winding $W_1$ of a voltage step-up transformer $T_2$ in the D. C. power supply is connected across the A. C. power supply terminals A and B through a line switch $S_1$ and a triac $Q_1$ of the air flow responsive switch. The control electrode of triac $Q_1$ is connected via a triggering diac $Q_2$ to one side of the A.C. power supply through a capacitor $C_1$ and to the other side thereof through resistors $R_1$ and $R_2$. Diac $Q_2$ will fire and cause conduction of triac $Q_1$ each half cycle of the A. C. power supply when capacitor $C_1$ is charged to the threshold voltage of diac $Q_2$. However, a thermistor T and a calibrating resistor $R_3$ are connected across capacitor $C_1$ through resistors $R_1$ and $R_2$ and when the resistance of thermistor T is reduced sufficiently by electrically heating it the capacitor $C_1$ is shunted and $Q_1$ remains nonconductive.

The resistance of thermistor T decreases as its temperature increases and its connection across the A. C. power source through resistors $R_1$, $R_2$ and $R_3$ passes sufficient current flow therethrough in the absence of a cooling air flow to heat the thermistor sufficiently to shunt the charging of capacitor $C_1$. Air flow around the thermistor T induced by air flow through the return air duct cools the thermistor and increases its resistance sufficiently to preclude shunting of capacitor $C_1$whereby current flows through triac $Q_1$ and the transformer primary winding $W_1$. Zener diodes $VD_1$ and $VD_2$ maintain a constant voltage on thermistor T. While an air flow switch employing a thermistor having a negative coefficient of resistance functioning to shunt the firing of $Q_1$ in the absence of air flow through the duct is illustrated and described, it will be understood that an air flow switch employing a positive coefficient of resistance and functioning to directly block firing of $Q_1$ under these conditions may be employed in lieu thereof.

The D. C. power supply further includes in addition to the voltage step-up transformer $T_2$, a voltage doubler network in which capacitors $C_2$ and $C_3$ are connected to opposite ends of the secondary winding $W_2$ of transformer $T_2$ through diodes $D_3$ and $D_4$ resulting in a potential between positive side O and negative side N in the order of 8 to 10 thousand volts. A somewhat smaller capacitor $C_4$ is connected directly across the secondary winding $W_2$ and functions as a filter to maintain a constant D. C. output voltage. The high voltage lead or cable 102 connects side O of the D. C. power supply with contactor elements 100 and 54 at the electrostatic cell 10 which in FIG. 15 is represented by parallel connected capacitor $C_7$ and resistor $R_{11}$.

The electrostatic cell 10 is grounded at G as to the return air duct but the D. C. power supply housed in box 108 is suitably insulated from ground.

Referring now to the signal light circuitry. Lamps $L_1$ and $L_2$ are gas filled lamps presenting high resistance to current flow until the gas therein becomes ionized and luminous with the application of sufficient voltage. Red lamp $L_1$ and parallel connected capacitor $C_5$ are connected between high voltage output O and negative side N of the D. C. power supply through lead 102, a resistor $R_4$ of high resistance, a resistor $R_6$ and a lead 130. When there is D. C. power but no current flow, as when the electrostatic cell 10 is disconnected from the D. C. power supply, red lamp $L_1$ will flash repeatedly due to the alternate charging of capacitor $C_5$ to the firing point of lamp $L_1$ and the discharging thereof and cut-off of the lamp when the lamp conducts.

Green lamp $L_2$ is connected between ground G, which is common with that of cell 10, and negative side N of the D. C. power supply through a resistor $R_{10}$, a lead 132, a PNP transistor $Q_4$, and resistor $R_6$. The base of transistor $Q_4$ is connected to ground G through a zener diode $VD_6$ and to side N through resistors $R_7$ and $R_6$. When the D. C. power supply is connected to the electrostatic cell 10 and there is a normal flow of current therethrough, as when the collector plates are relatively clean, the voltage drop at the base of transistor $Q_4$ will be sufficient to cause the conduction thereof and green lamp $L_2$ will glow steadily. The flashing of red lamp $L_1$ will however cease due to increased voltage at the lower end of resistor $R_6$ resulting from conduction through transistor $Q_4$ and lamp $L_2$ which is sufficient to prevent the charging of capacitor $C_5$ through the limiting resistor $R_4$. Resistor $R_5$ also limits the voltage available to charge capacitor $C_5$.

Red lamp $L_1$ is also connected between ground G and negative side N through resistor $R_{10}$, lead 112, a PNP transistor $Q_3$, a diode $D_5$ and resistor $R_6$. The base of transistor $Q_3$ is connected to ground G through a resistor $R_9$ and to side N through resistor $R_8$ and $R_6$. When there is an abnormally high current flow through cell 10, indicative of an accumulation of particulate matter on the cell collector plates requiring the cleaning thereof, the voltage drop at the base of transistor $Q_3$ will be sufficient to cause conduction of transistor $Q_3$ and the steady glow of red lamp $L_1$. As current flow through cell 10 increases above normal green lamp $L_2$ will be extinguished because the voltage drop at the base of $Q_4$ is limited by zener diode $VD_6$ while the voltage drop at the base of $Q_3$ increases thereby increasing conduction of $Q_3$ and because the emitters of transistors $Q_3$ and $Q_4$ are both connected to ground G through the resistor $R_{10}$ the emitter voltage of $Q_4$ will drop below that of its base as conduction increases through $Q_3$ thereby cutting off conduction of $Q_4$.

From the foregoing it will be seen that in the absence of a D. C. power supply both lamps $L_1$ and $L_2$ will be extinguished; when there is D. C. power and cell 10 is not connected thereto lamp $L_1$ will flash on and off; when the cell 10 is connected to the D. C. power supply and current flow through cell 10 is normal green light $L_2$ will glow steadily; and when the cell 10 is connected to the D. C. power supply and there is abnormal current flow through cell 10 red lamp $L_1$ will glow steadily.

INSTALLATION

When installing the electrostatic air cleaner in a return air duct or return air compartment of a furnace the template and support frame 66 is placed against the duct or furnace wall and the cut-out 70 and holes for attaching bolts marked. After the attachment holes are drilled and the cut-out in the duct wall made and the frame is secured to the duct wall the cell 10 is inserted through the cut-out rear frame member 14 first and with the holes 23 in the flange portions 22 of front frame member 12 receiving the locating pins 76. Cover 80 is now inserted into the template and support frame 66 with the holes 106 therein receiving the screw threaded studs 78. When the cover 80 is inserted into frame 66 the upper and lower spacing members 104 engage the flange portions 22 of the front frame member 12 of the cell and hold it in vertical alignment.

Also as cover 80 is inserted into frame 66 the contactor 100 engages the spring loaded contactor pin 54 and the portion 96 of insulator 88 engages the free end of the grounding leaf 56 spring thereby depressing it out of contact with contactor pin 54 so that the grounding connection is broken, see FIG. 12. Attachment of the nuts 79 to studs 78 secures the cover 80 to the frame 66 and holds the cell 10 in position in the duct. When the cover 80 is removed for any reason, as to extract the cell for cleaning, any residual high potential existing in the positive collector plates is immediately grounded through leaf spring 56.

The pairs of outwardly extending portions 24 of upper and lower horizontal frame members 16, in addition to increasing the stiffness of these frame members, are also so spaced as to form rails one inch wide to fit into existing tracks which may be present within a return air duct for receiving the usual conventional one inch thick fiberglass filter.

When attaching the power-pac and control box 108 the base portion of the box is disassembled from the cover portion by removing screws 116. The flat wall 110 of the base is then placed against the duct wall at a point spaced from the cell 10 and the holes for attaching drive screws 112 and air passage hole 122 are marked. When these holes are made in the duct wall the base is suitably secured to the duct wall by screws 112, the cover then attached to the base screws 116 and the lead 128 is plugged into a commercial A. C. power supply. It will be understood that the components and circuitry of the air-flow switch, the D. C. power supply and signal lights are supported on the cover portion of the box 108.

We claim:

1. The combination of an electrostatic air cleaner cell and a cutout template and support frame for defining a cutout to be made in the wall of a return air duct for the entry of said cell into the duct and for supporting one end of said cell in the duct wall, said cell comprising an open, rectangular metal frame supporting positively charged ionizing and collector elements therein, said cell frame consisting of elongated front and rear end members connected at their ends to the ends of two elongated side members, said cutout template and support frame including a flat marginal portion adapted to lie flat against a duct wall and to define a cutout to be made in the duct wall for insertion of said cell, means for securely connecting said flat marginal portion to the duct wall, said elongated front cell frame member having flat portions extending along opposite sides thereof arranged to overlie said flat marginal portion, and guide pins mounted on said marginal portion and arranged to enter apertures in said overlying flat portions of said front frame member when said cell is inserted rear frame member first into the duct through a cutout therein defined by said marginal portion, and a cover member arranged for detachable connection to said template and support frame, and said cover member having portions thereof overlying and engaging said flat portions of said front frame member when said cell is inserted into the duct and said cover member is attached to said template and support frame.

2. The combination set forth in claim 1 in which said elongated front cell frame member is of channel form in cross section and arranged to be inserted into the cutout in the duct wall, and in which said flat portions extending along opposite sides of said front cell frame member and arranged to overlie said marginal portion of said template and support frame are portions of the flanges thereof formed outwardly at 90 degrees.

3. The combination set forth in claim 1 in which said cutout template and support frame has a peripheral flange surrounding and extending perpendicular from said flat marginal portion and in which said cover member has side walls interfitting within said perpheral flange.

4. The combination set forth in claim 1 which further includes a first electrical contactor element mounted on said front cell frame member and connected to said positively charged elements of said cell, a second electrical contactor element mounted on said cover member and connected to an externally extending high voltage power supply lead and arranged to contact said first contactor element as said cover is moved into position for attachment to said template and support frame, and a conductive spring connected at one end to said front cell frame member and having a free end biased into engagement with said first contactor element thereby to normally ground said positively charged elements to said cell frame, and an insulator mounted on said cover member arranged to engage and move said free end of said spring out of engagement with said first contactor element when said cover member is moved to a position for attachment to said template and support member.

* * * * *

UNITED STATES PATENT AND TRADEMARK OFFICE

CERTIFICATE OF CORRECTION

PATENT NO. : 4,290,788

DATED : September 22, 1981

INVENTOR(S) : Robert R. Pittman; Clifford B. Elbrader; Jimmy L. Milum

It is certified that error appears in the above—identified patent and that said Letters Patent is hereby corrected as shown below:

"Assignee: Emerson Electric Co., St. Louis, Mo."

should be:

-- Assignee: Emerson Electric Co., St. Louis, Mo.; by said Clifford B. Elbrader and said Jimmy L. Milum --.

Signed and Sealed this

Twenty-first Day of August 1984

[SEAL]

Attest:

GERALD J. MOSSINGHOFF

Attesting Officer

Commissioner of Patents and Trademarks